United States Patent [19]

Bates

[11] Patent Number: 4,956,953

[45] Date of Patent: Sep. 18, 1990

[54] OFFICE PANEL SYSTEM INCORPORATING IMPROVED LOCKING AND ALIGNMENT MECHANISM

[76] Inventor: Norman H. Bates, 1182 Hyde Park, Santa Ana, Calif. 92705

[21] Appl. No.: 320,758

[22] Filed: Mar. 8, 1989

[51] Int. Cl.[5] ..... E04B 2/74

[52] U.S. Cl. ..... 52/239; 52/584; 52/741; 160/135

[58] Field of Search ..... 52/127.11, 239, 238.1, 52/281, 721, 36, 241, 584, 741; 160/135; 248/222.4, 223.1, 223.2; 312/245; 211/119.1, 119.01

[56] References Cited

U.S. PATENT DOCUMENTS

| | | | |
|---|---|---|---|
| 2,116,534 | 5/1938 | McCabe | 52/481 |
| 2,293,251 | 8/1942 | Fords | 211/119.1 |
| 2,577,323 | 12/1951 | Goenner | 52/761 |
| 3,049,197 | 8/1962 | Ludwig . | |
| 3,072,227 | 4/1963 | Baker . | |
| 3,324,440 | 6/1967 | Watkins | 52/239 |
| 3,425,171 | 2/1969 | Propst et al. | 52/36 |
| 3,517,467 | 6/1970 | Propst et al. | 52/36 |
| 3,605,851 | 9/1971 | Miles | 160/135 |
| 3,735,794 | 5/1973 | Lebowitz | 160/135 |
| 3,766,696 | 10/1973 | Totoonchie | 52/241 |
| 3,797,184 | 3/1974 | Thompson | 52/239 |
| 3,807,112 | 4/1974 | Perina | 52/241 |
| 3,809,142 | 5/1974 | Bleeker | 160/135 |
| 3,895,670 | 7/1975 | Bales | 160/135 |
| 3,949,827 | 4/1976 | Witherspoon | 181/33 |
| 3,987,836 | 10/1976 | LeMay | 160/135 |
| 4,031,675 | 6/1977 | Roberts et al. | 52/36 |
| 4,120,124 | 10/1978 | Temple et al. | 52/122 |
| 4,158,936 | 6/1979 | Fulton | 52/242 |
| 4,434,900 | 3/1984 | Cook | 211/189 |
| 4,601,137 | 7/1986 | Bates | 52/63 |

FOREIGN PATENT DOCUMENTS

| | | | |
|---|---|---|---|
| 664012 | 5/1963 | Canada | 52/239 |

*Primary Examiner*—John E. Murtagh

*Attorney, Agent, or Firm*—Richard L. Gausewitz

[57] ABSTRACT

Panels of the type used in an office panel system are provided with longitudinal grooves at the ends thereof, the grooves receiving a tube in such relationship that the tube can seat snugly in both grooves, and that the tube can rotate about its longitudinal axis. Complementary teardrop-shaped openings are provided at spaced points along the tube, each such opening having its axis in a plane perpendicular to the axis of the tube. Such openings cooperate with chamfered undercut screw heads to draw the panels together and align the panels with each other in response to rotation of the tube through one-quarter turn. A crank is provided at the lower end of the tube, to rotate the tube through one-quarter turn and simultaneously conceal the crank. An alignment pin cooperates with the tube slot to hold the tube at a predetermined elevation that greatly facilitates initiation of the entrance of the screw heads into the teardrop-shaped openings. In addition, an alignment element are provided at the top rail to increase the precision of alignment at the top rail.

20 Claims, 3 Drawing Sheets

FIG. 2.
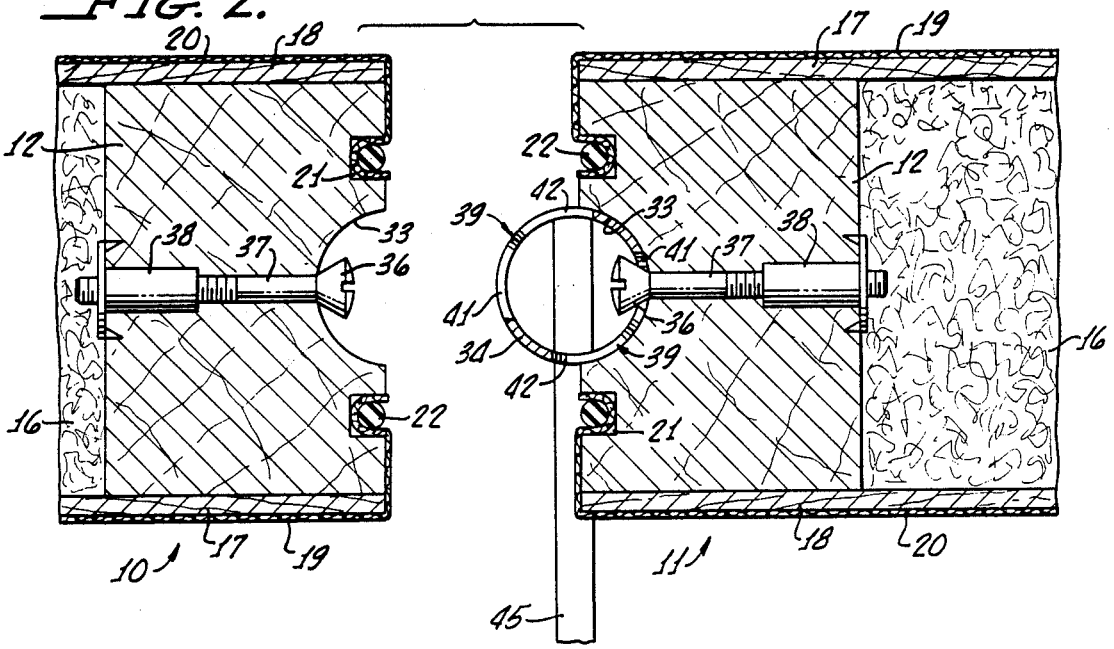
FIG. 3.
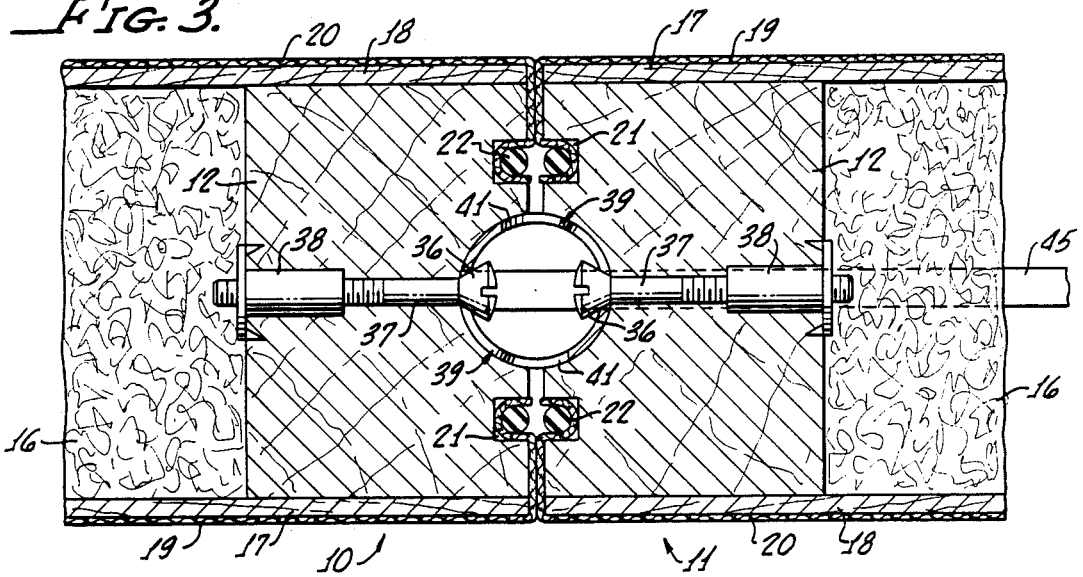
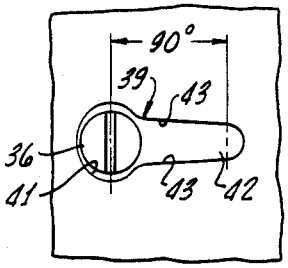
FIG. 4.
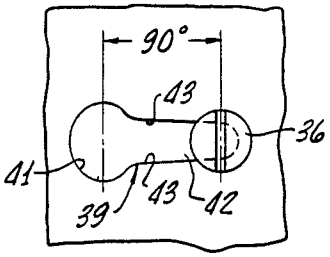
FIG. 5.

FIG. 6.
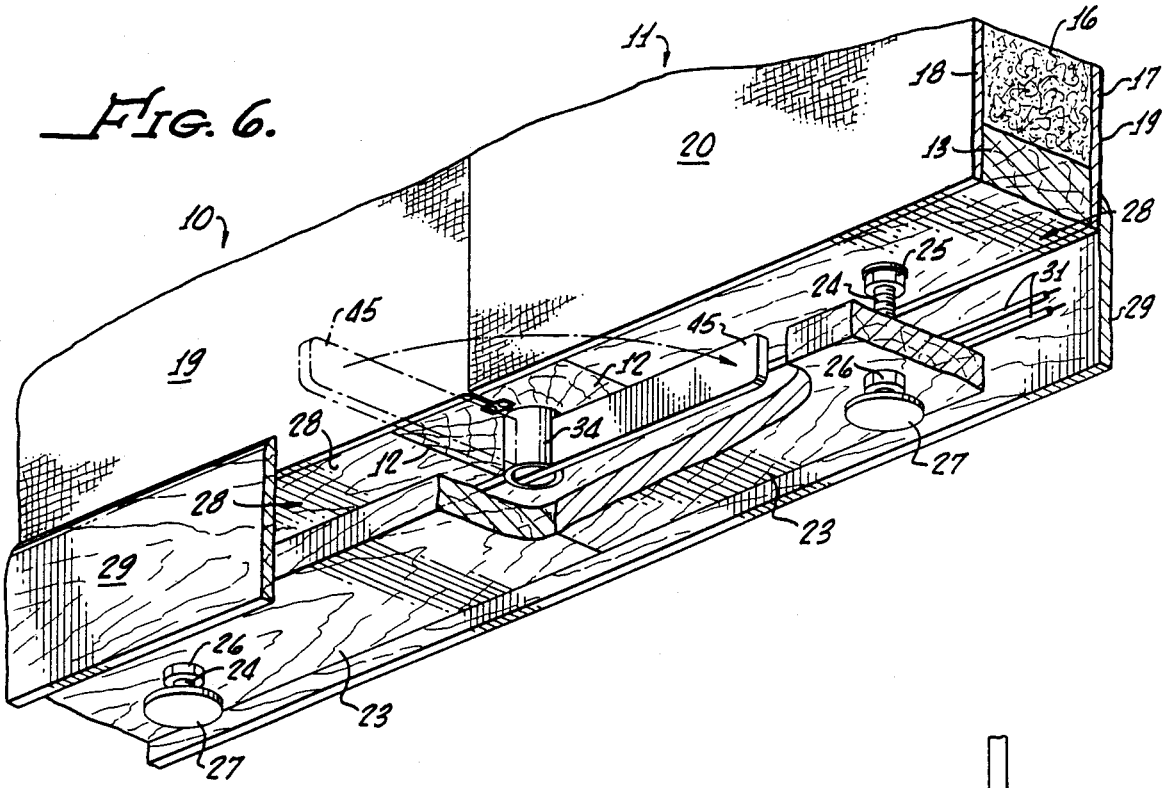
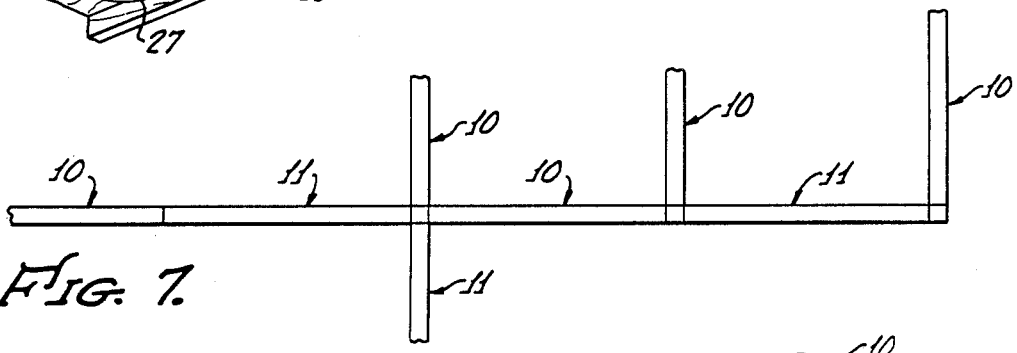
FIG. 7.
FIG. 8.
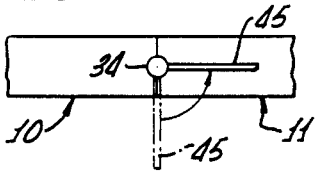
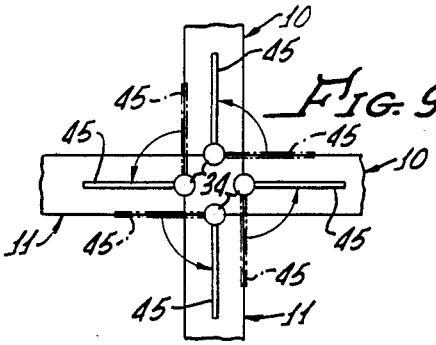
FIG. 9.
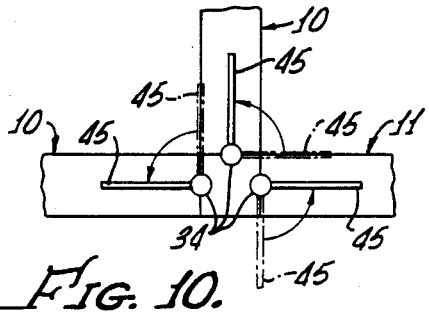
FIG. 10.
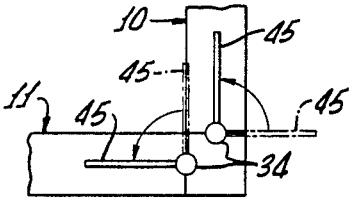
FIG. 11.

OFFICE PANEL SYSTEM INCORPORATING IMPROVED LOCKING AND ALIGNMENT MECHANISM

BACKGROUND OF THE INVENTION

At least as early as 1966 it was known to draw together the edges of panels of an office panel system by using cooperating wedge-shaped keeper buttons and pear-shaped slots, the slots being in a vertical element that was moved vertically by means of a screw (Propst U.S. Pat. No. 3,425,171). Seventeen years later, the present inventor made major improvements over the above-indicated office panel system, but still used a vertically-movable element and cooperating teardrop-shaped openings and chamfered screw heads. The teardrop openings were in the vertical element, which was actuated by means of a bolt.

In both of the indicated office panel systems, the threaded fastener had to be turned by means of a tool. Furthermore, the bolt or screw head was either exposed to view or had to be separately concealed. In addition, to disconnect the panels from each other, in order to arrange them in a different configuration, it was sometimes necessary to hammer on the fastener after it had been rotated through a substantial number of revolutions.

The above office panel systems were also characterized by a certain difficulty in initiating the connection operation, that is to say difficulty in causing the screw heads to enter the wide ends of the slots in the vertically-movable member.

SUMMARY OF THE INVENTION

The present invention eliminates the requirement for tools, and achieves other advantages, by causing the vertical element to move rotationally instead of longitudinally. Rotational movement of the vertical element is effected by a crank which shifts from an outwardly-extending position to a concealed position beneath a panel, there being no opening in the top rail that requires concealment or that defaces the rail.

Cooperating elements are provided in the vertical element and in the ends of the panels to draw the panels together and to align them in response to rotation of the vertical element. In the preferred embodiment, such cooperating elements are teardrop-shaped slots in the vertical element and which have horizontal axes. The cooperating elements further comprise chamfered bolt heads shaped and sized to cooperate with the teardrop slots. Such bolt heads are in elongated grooves or recesses that preferably have semicylindrical shapes and that snugly receive the vertical element which is preferably a hollow cylinder.

To greatly facilitate initiation of entry of the bolt heads into the wide ends of the teardrop slots, alignment pins are extended from the ends of the panel sections and are adapted to penetrate alignment slots. The locations of the pins and slots are such that when such pins are in the slots the chamfered bolt heads will be registered with the teardrop slots. In addition, alignment dowels are provided in the rail to make sure that there is extreme precision of registration of the rail ends relative to each other.

BRIEF DESCRIPTION OF THE DRAWINGS

FIG. 2 is a fragmentary horizontal sectional view showing such end portions as being in the same plane, during the initial phase of the connection and alignment operation, the section being taken immediately above two opposed bolts;

FIG. 3 corresponds to FIG. 2 but illustrates the conditions of the parts after the panels have been moved together and the tube has been rotated one-quarter turn, in order to complete the connection and alignment operation;

FIG. 4 is a fragmentary side elevational view showing one of the teardrop-shaped slots and showing a chamfered bolt head in the wide end of such slot;

FIG. 5 corresponds to FIG. 4 but shows the condition of the parts after the tube has been turn ninety degrees in order to cause the bolt head to be in the narrow end of the slot;

FIG. 6 is a fragmentary isometric view of the bottom portion of the mated panel sections, illustrating how the crank is rotated one-quarter turn in order to complete the connection and alignment operations and to effect concealment of the crank beneath one of the panel ends;

FIG. 7 is a schematic plan view illustrating different types of associations of panel sections with each other;

FIG. 8 is a schematic plan view illustrating the connections of the two panel sections of FIGS. 1–6 in the same vertical plane;

FIG. 9 is a schematic plan view illustrating the connection of four panel sections to each other in X relationship;

FIG. 10 is a schematic plan view illustrating the connections of three panel sections to each other in T relationship; and FIG. 11 is a schematic plan view illustrating the connections of two panel sections to each other at a corner.

DETAILED DESCRIPTION OF THE PREFERRED EMBODIMENT

Figure 1:
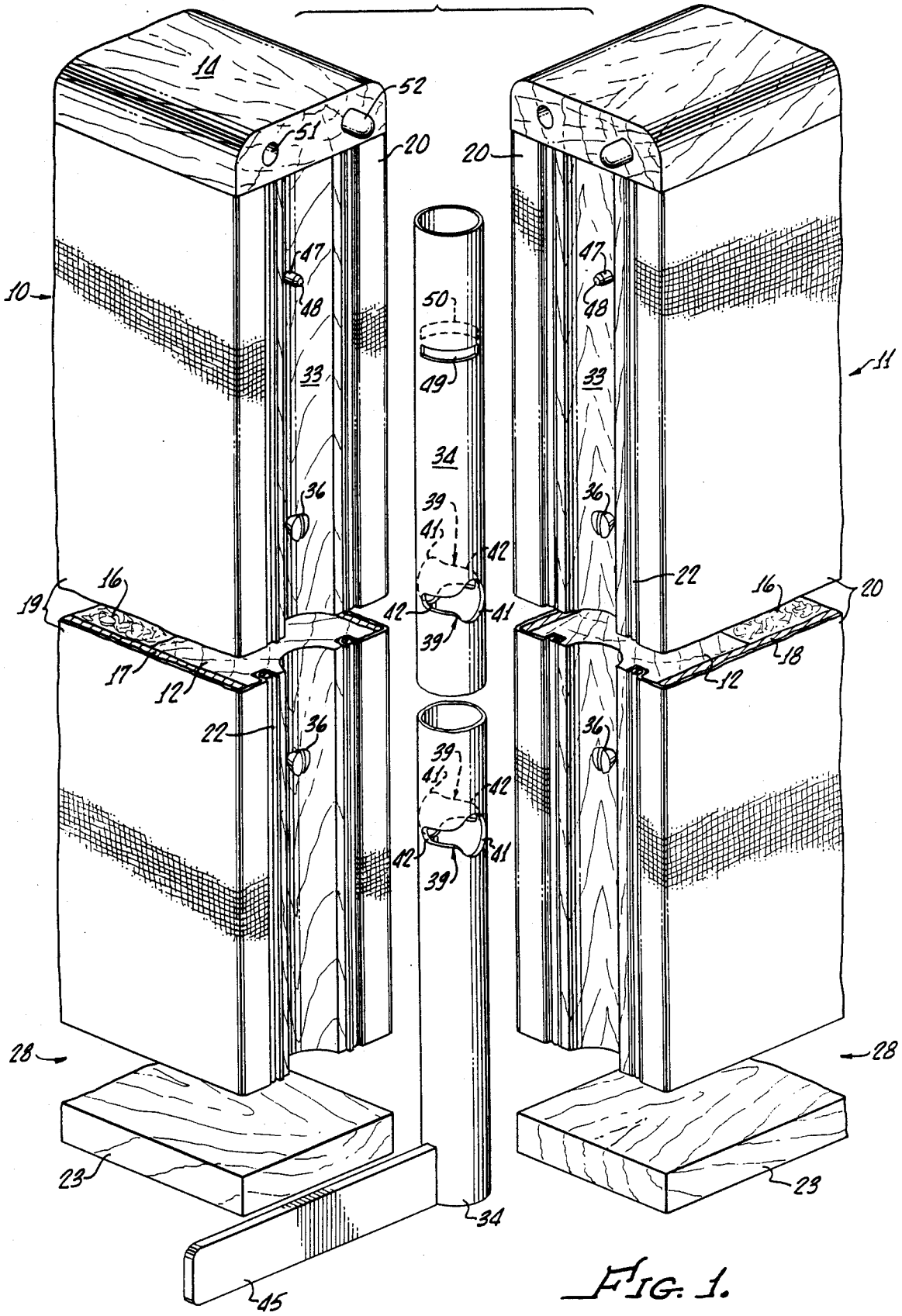
FIG. 1 is a partially exploded isometric view, partially broken away and sectioned, illustrating the end portions of two identical panels of an office panel system together with the associated connection and alignment tube, it being emphasized that the panels associated with the illustrated tube are normally in the same vertical plane but are shown as angularly oriented for purposes of clarity of illustration.

The present combination comprises a large number of identical panels of an office panel system, such panels—with the major exception of the connection and alignment method and mechanisms—being similar to those described in detail in my prior U.S. Pat. No. 4,601,137. Such patent is hereby incorporated by reference herein.

Referring to FIGS. 1, 2, 3 and 6, there are illustrated two identical panels 10, 11, of which only the most major components are shown. These most major components comprise a rectangular frame formed of wood or other suitable material. Each frame consists of vertical end rails 12 (only one of which is shown, the other being identical but at the other end), a bottom rail 13 (FIG. 6), and a decorative top rail 14. The frame components 12–14 are rigidly secured to each other adhesive and/or fasteners, not shown.

Foam material 16 is mounted inside the described frame, being closely encompassed by the rails. Resilient sheets 17, 18 are disposed over the foam material and over the sides of the four rails of each panel, to form bases for the decorative outer material and to cause the latter to be smooth. Provided over the exterior surfaces of sheets 17, 18, and extending around the corners of the rails, are outer coverings 19, 20 which may be, for example, decorative outer fabrics.

As described in the above-cited patent, the outer covering 19, 20, after extending around the corners of the resilient sheets 17, 18 and end rails 12, is secured in grooves 21 in the exposed faces of the end rails 12. Such securing is preferably by tubes or beads 22 of resilient material.

Resilient rubber-like molding members, not shown, are preferably provided beneath the fabric sheets 19, 20 between beads 22 and the corners, as described in the above-cited patent. Such molding members cause the ends of the panels 10, 11 to be somewhat soft, and to permit insertion of shelf supports, etc., between the panel ends, as described in such patent. The soft panel ends provide close-fitting pressure joints when the panels are pulled together by the present mechanism.

Referring next to FIG. 6, the bottoms of the panels are not the same as shown in the cited patent. Instead, base rails 23 are mounted in spaced parallel relationship below bottom rails 13, such mounting being effected by bolts 24 (or other elements) that extend through bottom rails 13 and also through the base rails, the bolts being associated with nuts 25, 26. The bolts 24 have leveler pads 27 at the bottoms thereof. Thus, turning of the bolts will adjust the heights of pads 27 to properly level the panels 10, 11 despite irregularities in the underlying floor.

The bolts 24 are spaced inwardly from the vertical abutting edges of the panels, that is to say are spaced inwardly from the end rails 12. With such construction, there is a continuous space 28 (FIGS. 1 and 6) beneath the abutting end rails 12.

Baseboards 29 are suitably mounted by fastener means, not shown, to the edges of base rails 23 and extend upward to the lower portions of the panel fabric 19, 20. The mounting may comprise, for example, hook-and-loop fastener elements, not shown, which permit rapid mounting and removal of the baseboards 29. Electrical wiring, etc., is mounted in the space 28, a small portion of such wiring being indicated at 31 in FIG. 6.

DETAILED DESCRIPTION OF THE CONNECTION AND ALIGNMENT MECHANISM

Referring to FIGS. 1–3, a substantially semicylindrical vertical recess or groove 33 is formed centrally of each vertical end rail 12. The recesses or grooves 33 are sized to snugly but rotatably receive an elongate hollow cylindrical tube 34, the tube length being such that it fills substantially the entire grooves and also extends somewhat therebelow. The ends of the decorative top rails 14 are not grooved, and the upper end of tube 34 does not extend above the upper ends of rails 12.

Provided at spaced points along the bottoms of grooves 33 are the chamfered heads 36 of bolts 37. The bolts 37 extend through end rails 12, and are firmly secured against withdrawal by T-nuts 38 shown in FIGS. 2 and 3.

As shown in FIGS. 1–3, each head 36 has a large-diameter outer end that is connected by a truncated cone to the associated shank of bolt 37. The truncated cone converges toward the bolt shank, that is to say away from the plane of the outer face of end rail 12, so that an undercut relationship is created.

The bolt heads are slotted so as to receive a screwdriver that turns each bolt into a T-nut. The amount of insertion is such that the junction between the frustoconical body of each head is substantially at the bottom wall of the associated groove or recess 33.

Complementary pairs of teardrop-shaped slots 39 are provided in tube 34 so as to cooperate with the opposed bolt heads 36 to draw them together in response to rotation of the tube 34 about its longitudinal axis. There are two slots at each elevation, and the spacings between the pairs of slots are such that all slots can be and are simultaneously associated with all bolt heads 36.

As best shown in FIGS. 1, 4 and 5, the axes of the slots 39 are horizontal, that is to say perpendicular to the longitudinal axis of tube 34. Each slot has a wide end 41 that is substantially circular and is adapted to freely receive a bolt head 26. Each such wide end communicates with a gently convergent section having converging cam edges 43 that converge away from the wide end 41, the spacings between the opposed regions of the convergent edges being such that the associated bolt head may not pass therethrough. The amount of convergence is such that when the tube 34 has rotated one-quarter turn the tube will pull the panels 10, 11 towards each other until the tube seats snugly in the substantially semicylindrical recesses or grooves 33. Each slot 39 extends for substantially ninety degrees, on centers, as shown in FIGS. 4 and 5.

At each slot region of the tube 34, the wide end 41 of one slot 39 is circumferentially adjacent the end of the convergent section 41 of the other slot in the sam plane. By "circumferentially adjacent" it is not meant that there is no spacing therebetween, since there is circumferential spacing as shown in FIGS. 2 and 3. What is meant is that both slots 39 in each plane can and do operate simultaneously relative to the opposed bolt heads 36 to achieve the connecting and aligning functions of the present invention.

To rotate tube 34 through one-quarter turn about its longitudinal axis, there is provided at the bottom of tube 34 a crank 45 that extends radially and create considerable mechanical advantage. The inner end of crank 45 is preferably extended through a slot in one side of tube 34, and then welded in position. The length of tube 34 is such, and the position of crank 45 is such, that when the slots 39 are associated with bolt heads 36, the crank 45 is at the same elevation as the spaces 28 between bottom rails 13 and base rails 23 (reference being made to FIG. 6).

The circumferential position of crank 45 on tube 34 is correlated to the slots 39, in such manner that the crank extends substantially perpendicular to both panels 10, 11 (which then lie in the same plane, as shown in FIGS. 2 and 3). This outwardly-extending relationship of the crank is shown in FIG. 2. After the crank has been rotated ninety degrees to cause the bolt heads 36 to shift from the wide ends 41 of the slots to the ends of the convergent sections 42 thereof, the crank is beneath a lower rail 13 and disposed in a space 28 where it is completely out of sight and is later concealed by baseboard 29 (FIG. 6).

Not only is the present assembly made in the absence of any tools, in the preferred embodiment, but means are provided to effect initial alignment between bolt heads 36 and the wide ends 41 of the slots 39. Referring to FIG. 1, such means comprises alignment pins 47 the outer ends 48 of which are preferably beveled. The pins are adapted to be received in arcuate slots 49, 50 that are provided in tube 34 and that lie in the same horizontal plane perpendicular to the longitudinal axis of the tube.

The pins 47 and slots are preferably near the tops of the panels, so that the tube hangs from one of the pins.

The pins 47 extend outwardly from the bottoms of the grooves or recesses 33. Only one pin is needed, but two are provided so that the panels can be 100% identical.

The relationships between the pins 47, slots 49, 50, bolt heads 36 and teardrop slots 39 are such that when the outer end of a pin 47 is inserted into its slot, the bolt heads are at the proper elevations and positions to be inserted into the wide ends 41 of slots 39, this occurring when the crank 45 is perpendicular to the aligned panel sections as stated above. The amount of arcuate extension of the grooves 49, 50 is such that turning of the tube 34 through ninety degrees is not interfered with by the pins 47.

There is also provided additional alignment means that cooperates with tube 34 and bolt heads 36 in achieving very high-precision alignment of the decorative top rails 14, despite (for example) any possible slight warping of the frames of the panels 10, 11.

As shown at the top in FIG. 1, the vertical end face of each decorative rail 14 has a horizontal cylindrical bore 51 on one side thereof and dowel 52 on the other side thereof, the dowel 52 being bullet-shaped at its end. Each dowel is adapted to fit snugly into an opposing hole or bore. The dowels 52 and bores 51 are so located that when the dowels are inserted in the opposed bores the rails 14 will be in high-precision alignment with each other, so that the dowels and bores cooperate with the tube 34, and recesses or grooves 33, together with the bolt heads 36 and their associated slots 39, in providing alignment or "key" relationships that keep the ends of the panels 10, 11 in precision alignment.

OPERATION

Assembling panels 10, 11 together by means of the present invention is extremely simple. Assembly normally does not involve any guess work or final slight movements of the elongated alignment and connection element 34. Instead, everything normally fits easily together the first time.

The panel sections 10, 11 are disposed with their end faces opposite each other, the panel sections being in the same plane.

Then, or previously (even at the factory), tube 34 is hung on one of the pins 47, by moving the tube until the associated slot 49, 50 is penetrated by pin 47 and, furthermore, the crank 45 projects perpendicularly to the plane of the panels. Very preferably, the tube 34 is pushed all of the way into the groove or recess 33 having the pin 47 which hangs the tube 34.

It is emphasized that only one pin 47 is required; two pins and the associated slots are shown because it is desired that all panels be identical in every way. Because the pin on which the tube 34 hangs is, preferably, at the upper end of its associated groove or recess 33, the tube 34 hangs from the pin and therefore does not tend to fall off.

When the tube is pushed so that it is hung on pin 47, with the crank 45 vertical to the plane of the panels as stated, the bolt heads 36 on the same panel as the hanging tube automatically enter the wide ends 41 of the slots 39. Furthermore, despite the large diameters of such wide ends 41, and despite the frustoconical shapes of the bolt heads 36, the tube 34 does not drop down (until the top edges of wide ends 41 seat on the bolt heads) because the pin 47 holds the tube at the proper desired elevated condition.

Thereafter, the panels are shifted towards each other until dowels 52 penetrate bores 51, and until the bolt heads 36—of the panel on which the tube 34 was not hung—penetrate the wide ends 41 of the remaining slots 39 as desired. At the same time, the remaining pin 47 penetrates the remaining pin slot 49 or 50.

Assuming, for example, that the tube 34 was initially mounted in the groove or recess 33 of panel section 11, so that the tube was hung on the pin 47 which projects through slot 49, the parts are then in the position of FIG. 2. Then, the panel ends are pushed together. It is then merely necessary to rotate crank 45 ninety degrees so that cam and wedging actions are created between the various bolt heads 36 and their associated slots 39 to firmly shift the opposed ends into the fully-closed positions shown in FIG. 3. The parts are thus firmly connected and precisely aligned with no substantial difficulty, last-second adjustment, or guess work.

It is then merely necessary to mount the baseboards 29 (FIG. 6) to conceal the crank 45 and wiring, etc.

It is to be understood that holes ar provided in the tube 34 correspondingly to holes 102 shown in FIG. 2 of the above-cited patent, and further that shelf brackets are provided as indicated at 52 in such patent.

Referring next to schematic FIGS. 7–11, the panels 10, 11 are shown as connected together in various relationships, including X-relationship, T-relationship, and corner or right-angle relationship. It is to be remembered that the panels are absolutely identical to each other, even though they are given different numbers 10, 11 relative to FIGS. 1–6 for purposes of clarifying the description relative to FIGS. 1–6.

FIG. 8 shows the left joint in FIG. 7, and which was described in detail relative to FIGS. 1–6. FIG. 9 shows the second-from-the-left joint in FIG. 7; FIG. 10 shows the third-from-the-left joint in FIG. 7; while FIG. 11 shows the right joint in FIG. 7. Relative to FIGS. 9–11, the panels are associated with suitable posts or corners of the general type shown in FIGS. 6*a*, 6*b*, and 6*c* in the above-cited patent, with the major exceptions of the types of connections and alignments.

In each of FIGS. 8–11, the crank 45 is shown in solid lines in its retracted or fully-assembled condition, and is shown in phantom lines in the condition assumed prior to quarter-turn movement that achieves such final assembled relationship. It is emphasized that the crank 45 may extend in either direction from the panel sections 10, 11, so that there is full flexibility relative to making different arrangements of panels, for example as indicated above relative to FIGS. 7–11.

The foregoing detailed description is to be clearly understood as given by way of illustration and example only, the spirit and scope of this invention being limited solely by the appended claims.

What is claimed is:

1. A panel system, which comprises:

(a) first and second office panel sections each having a vertical end that it is desired to connect to the vertical end of another office panel section, and so that said first and second office panel sections will be aligned and coplanar, (b) projecting elements provided on each of said ends in vertically-spaced relationship, (c) an elongate connector and alignment element disposed in vertical relationship between the opposed vertical ends of said first and second panel sections to cooperate with said projecting elements in connecting said ends together, and in aligning said panel sections relative to each other, (d) means on said connector and alignment element to interact with said projecting elements to effect said connection of said ends to each other and to effect said alignment of said panel sections, characterized in that said last-named means effects said connection and alignment in response to rotation of said connector and alignment element about the longitudinal axis thereof, further characterized in that said projecting elements and said last-named means are so shaped and related that said rotation of said connector and alignment element effects pulling of said panel sections towards each other, and (e) means on said first and second panel sections to come into abutment with each other in response to said pulling of said panel sections towards each other, said last-named means being so disposed that the connected panel sections are maintained in substantially the same plane, without the necessity of relying on friction.

2. The invention as claimed in claim 1, in which each of said projecting elements has wide and narrow portions, the wide portion of each projecting element being farther from the panel section, with which the projecting element is associated, than is the narrow portion of such projecting element, and in which said last-named means has edge portions that cooperate with said narrow portions of said projecting elements, said edge portions and said narrow portions being so shaped and related that said rotation of said elongate connector and alignment element effects said pulling of said panel sections towards each other.

3. The invention as claimed in claim 1, in which pre-alignment means are provided to mount said elongate connector and alignment element on the end of only one of said office panel sections in correct association with those of said projecting elements that are on said one section, and in which said pre-alignment means holds said connector and alignment element at the correct elevation for automatic correct association with said projecting elements on the other of said office panel elements when said office panel sections are pushed together, said pre-alignment means permitting said rotation of said connector and alignment element to connect and align said ends.

4. The invention as claimed in claim 1, in which said office panel sections have top rails, and in which alignment means that fit snugly into hole means in the ends of said top rails, adjacent said vertical ends, are provided to further align said panel sections.

5. The invention as claimed in claim 1, in which manually-operable means are mounted on said elongate connector and alignment element to effect said rotation thereof about its longitudinal axis, so that no tools are required.

6. An office panel system, comprising:

(a) a plurality of identical rectangular panels each having a vertical groove in each end, (b) an elongate connection and alignment tube shaped to fit snugly into two opposed ones of said grooves, (c) said panels having chamfered fastener heads in said grooves, (d) said tube having teardrop-shaped openings shaped and located to receive said fastener heads and then to pull opposed panel section together when said tube is moved, and (e) pin and opening means provided in said panels and in said tube to hold said tube at the correct elevation to receive the fastener heads of both panels to be connected together, thereby eliminating guesswork from panel connection.

7. A method of connecting office panel sections together, which comprises:

(a) providing two office panels each having a vertical groove in each vertical end thereof, (b) providing chamfered fastener heads in each of said grooves, (c) providing a pre-alignment pin in at least one of said grooves, (d) providing an elongate tube shaped to fit in said grooves, said tube having teardrop-shaped slots therein to receive said fastener heads, and having an opening therein to receive said pin, said opening having an upper edge region the position of which is so correlated to said teardrop-shaped slots that when said edge region hangs on the said pin, said teardrop-shaped slots are in positions to receive in the wide ends thereof said fastener heads of both of said panels, (e) mounting said tube in said one groove with said opening receiving said pin and with the wide ends of said slots receiving said fastener heads in said one groove, (f) thereafter, without shifting said tube relative to said one groove, moving the ends of said panels together to cause said tube to enter said groove of said other panel and to receive in the wide ends of some of its teardrop-shaped slots the chamfered heads of the fasteners in said groove in said other panel, and (g) thereafter shifting said tube to cause said fastener heads to be in the narrow ends of said teardrop-shaped slots.

8. An office panel system, which comprises:

(a) a plurality of substantially identical rectangular office panels each having a vertical groove in each vertical end thereof, (b) a hollow tube shaped to fit with one side thereof in one of said grooves and the other side thereof in an opposing one of said grooves, (c) chamfered fastener heads mounted in each of said grooves at spaced points therealong, and having larger diameter outer ends, and (d) complementary pairs of teardrop-shaped slots provided in said tube and sized, shaped and positioned to receive simultaneously all of said fastener heads, said slots having their axes substantially in planes perpendicular to the longitudinal axis of said tube, the wide ends of said slots being sized to receive said large-diameter ends of said fastener heads, the narrow ends of said slots being too small to receive such large diameter ends, whereby when said tube is rotated about the longitudinal axis thereof said fastener heads will shift into said narrow ends of said slots and said panels will be secured together.

9. The invention as claimed in claim 8, in which a crank is mounted at the bottom end of said tube to rotate it, and in which said panels have unobstructed open spaces at bottom regions near said panel ends so that said panels may be turned ninety degrees to positions in said spaces beneath said panels.

10. The invention as claimed in claim 9, in which pre-alignment means are provided on said panels and tube to hang said tube at the correct height to receive said large-diameter ends of said slots when said crank is perpendicular to said panels.

11. The invention as claimed in claim 10, in which said panels have top rails the ends of which have aligning dowels and bores.

12. An office panel system, which comprises:

(a) first and second office panel sections each having a vertical end that it is desired to connect to the vertical end of another office panel section, in such manner that said first and second panel sections will be aligned and coplanar, each of said panel sections having, on said vertical end thereof, a first means for effecting connection between said ends of said first and second panel sections and for causing said panel sections to be aligned, (b) an elongate connector and alignment element disposed in vertical relationship between the opposed vertical ends of said first and second panel sections for use in connecting said ends together, and in aligning said panel sections relative to each other, (c) second means, provided on said connector and alignment element, to interact with said first means to effect said connection of said ends to each other and to effect said alignment of said panel sections, characterized in that said second means interacts with said first means, and consequently connects and alignments said panel sections, in response to rotation of said connector and alignment element about the longitudinal axis thereof, further characterized in that said second means and said first means are so shaped and related that said rotation of said connector and alignment element effects pulling of said panel sections towards each other, and (d) means on said first and second panel sections to come into abutment with each other in response to said pulling of said panel sections towards each other, said last-named means being so disposed that the connected panel sections are maintained in substantially the same plane, without the necessity of relying on friction.

13. The invention as claimed in claim 12 in which pre-alignment means are provided to mount said elongate connector and alignment element on the end of only one of said office panel sections in correct association with those of said first means that are on said one section, and in which said pre-alignment means holds said connector and alignment element at the correct elevation for automatic correct association with said first means on the other of said office panel elements when said office panel sections are pushed together, said pre-alignment means permitting said rotation of said connector and alignment element to connect and align said ends.

14. The invention as claimed in claim 12, in which said office panel sections have top rails, and in which alignment means that fit snugly into hole means in the ends of said top rails, adjacent said vertical ends, are provided to further align said panel sections.

15. The invention as claimed in claim 12, in which manually-operable means are mounted on said elongate connector and alignment element to effect said rotation thereof about its longitudinal axis, so that no tools are required.

16. The invention as claimed in claim 12, in which said first and second means are so constructed and related as to effect said connection and alignment in response to said rotation of said elongate connector and alignment element through a fraction of one revolution.

17. An office panel system, comprising:

(a) a plurality of identical rectangular vertical panel sections each having a vertical groove in each end, (b) an elongate connection and alignment tube shaped to fit snugly into two opposed ones of said grooves, said panel sections, having first cam means in said grooves, said tube having second cam means shaped and located to engage said first cam means and then to pull opposed panel sections together when said tube is rotated about the longitudinal axis thereof, characterized in that said cam means are such that said panel sections do not move vertically at any time during connection thereof to said tube, and (c) means on the end of each of said panel sections to abut corresponding means on the adjacent end of the other panel section and thereby cause said panel sections to be substantially coplanar after being pulled together in response to said rotation of said tube.

18. The invention as recited in claim 17, in which means are provided in said panel sections and in said tube to hold said tube at the correct elevation to interact with said first cam means of both panel sections to be connected together, thereby eliminating guesswork from panel section connection.

19. An office panel system, which comprises:

(a) first and second office panel sections each having a vertical end that it is desired to connect to the vertical end of another office panel section, and so that said first and second panel sections will be aligned in coplanar relationship, each of said panel sections having, on said vertical end thereof, a first means for effecting connection between said ends of said first and second panel sections and for causing said panel sections to be aligned with each other, (b) an elongate connector and alignment element disposed in vertical relationship between the opposed vertical ends of said first and second panel sections for connecting said ends together, and for aligning said panel sections relative to each other, (c) second means on said connector and alignment element to interact with said first means to effect said connection of said ends to each other and to effect said alignment of said panel sections, characterized in that said second means interacts with said first means, and consequently connects and aligns said panel sections, in response to rotation of said connector and alignment element about the longitudinal axis thereof, further characterized in that said first and second means pull said vertical ends of said first and second office panel sections towards each other in response to said rotation, and (d) means additional to said connector and alignment element, and said first and second means, to cause said first and second panel sections to be coplanar after said rotation and consequent pulling having occurred, said last-named means comprising abutments on said vertical ends of said panel sections, to maintain said panel sections coplanar without need for reliance on friction.

20. The invention as claimed in claim 19, in which said first and second means are so constructed and related as to effect said connection and alignment and pulling in response to said rotation of said elongate connector and alignment element through a fraction of one revolution.

* * * * *